US005128026A

United States Patent [19]

Newman et al.

[11] Patent Number: 5,128,026

[45] Date of Patent: Jul. 7, 1992

[54] PRODUCTION OF UNIFORM PREMIUM COKE BY OXYGENATION OF A PORTION OF THE COKE FEEDSTOCK

[75] Inventors: Bruce A. Newman; Lloyd G. Becraft, both of Ponca City, Okla.

[73] Assignee: Conoco Inc., Ponca City, Okla.

[21] Appl. No.: 700,380

[22] Filed: May 13, 1991

[51] Int. Cl.[5] ..... C10G 9/14; C10G 17/00

[52] U.S. Cl. ..... 208/131; 208/48 R; 208/50

[58] Field of Search ..... 208/131

[56] References Cited

U.S. PATENT DOCUMENTS

| | | | |
|---|---|---|---|
| 2,336,056 | 12/1939 | Bell | 208/50 |
| 2,905,615 | 9/1959 | Arey | 208/50 |
| 3,112,181 | 11/1963 | Petersen et al. | 208/50 |
| 3,960,704 | 6/1976 | Kegler et al. | 208/50 |
| 4,530,757 | 7/1985 | Rankel et al. | 208/50 |
| 4,758,329 | 7/1988 | Newman et al. | 208/131 |

*Primary Examiner*—Helane Myers

[57] ABSTRACT

More uniform premium coke is obtained in a delayed coking process by oxygenating the latter portion of the premium coking feed introduced to the coking drum.

10 Claims, 4 Drawing Sheets

PRODUCTION OF UNIFORM PREMIUM COKE BY OXYGENATION OF A PORTION OF THE COKE FEEDSTOCK

BACKGROUND OF THE INVENTION

There is an increasing demand for high quality premium coke for the manufacture of large graphite electrodes for use in electric arc furnaces employed in the steel industry. The quality of premium coke used in graphite electrodes is often measured by its coefficient of thermal expansion which may vary from as low as $-5$ to as high as $+8$ centimeters per centimeter per degree centigrade times $10^{-7}$. Users of premium coke continuously seek graphite materials having lower CTE values. Even a small change in CTE can have a substantial effect on large electrode properties.

Premium coke is manufactured by delayed coking in which heavy hydrocarbon feedstocks are converted to coke and lighter hydrocarbon products. In the process the heavy hydrocarbon feedstock is heated rapidly to cracking temperatures and is fed into a coke drum. The heated feed soaks in the drum in its contained heat which is sufficient to convert it to coke and cracked vapors. The cracked vapors are taken overhead and fractionated with the fractionator bottoms being recycled to the feed if desired. The coke accumulates in the drum until the drum is filled with coke at which time the heated feed is diverted to another coke drum while the coke is removed from the filled drum. After removal the coke is calcined at elevated temperatures to remove volatile materials and to increase the carbon to hydrogen ratio of the coke.

In the manufacture of large graphite electrodes, calcined premium coke particles obtained from the delayed coking process are mixed with pitch and then baked at elevated temperatures to carbonize the pitch.

The delayed coking operation is a semi-continuous process in which the feed material is introduced continuously to the coke drum during the coking cycle. If the coking cycle lasts for say 30 hours, the feed material first introduced to the coke drum is subjected to coking conditions for this period of time. Each succeeding increment of feed, however, is coked for a lesser period of time, and the final portion of feed material introduced to the coke drum is subjected to coking conditions only for a relatively short period of time. In view of this, it is understandable that problems are encountered in obtaining coke product which is homogeneous. Coke produced near the top of the drum, where reaction times are short, generally has different physical properties, e.g., CTE and Crush Index, than coke produced in the remainder of the drum. Coke which is not uniform presents a problem for graphite producers in a number of ways. Pitch demand, coke sizing, and ultimate electrode performance all become difficult to predict if coke properties are not consistent.

THE PRIOR ART

U.S. Pat. No. 2,336,056 to Bell discloses a method for converting residual oils into lighter fractions and coke by adding air to the preheated residual oil.

U.S. Pat. No. 2,905,615 to Arey discloses a method of increasing the yield of coke by subjecting the charge stock to a preliminary oxidation treatment.

U.S. Pat. No. 3,112,181 to Petersen discloses the production of isotropic coke from distillate wherein the distillate feedstock is first contacted with oxygen or oxygen-containing gas prior to being subject to coking operation.

U.S. Pat. No. 3,960,704 to Kegler et al. discloses the manufacturing of isotropic delayed coke by air blowing a petroleum residuum to produce a delayed coking feedstock and then coking the air blown residuum under delayed coking conditions.

U.S. Pat. No. 4,530,757 to Rankel et al. discloses a method for upgrading heavy crude oil by oxidizing the crude oil in the first stage and then coking the oxidized oil in the second stage, settling of the coked oil in the third stage and thereafter recovering an upper phase product of reduced metal content.

U.S. Pat. No. 4,758,329 to Newman et al. discloses a delayed coking process wherein a sparging gas is introduced to the coking reaction during the entire delayed coking cycle. However, it is preferred to sparge during the later part of the cycle.

THE INVENTION

According to this invention, premium coke having more uniform properties is produced by oxygenating the latter portion of the aromatic oil coking feedstock which is introduced to the coking drum in a delayed coking process.

DETAILED DESCRIPTION OF THE INVENTION

The fresh feedstocks used in carrying out the invention are heavy aromatic mineral oil fractions. These feedstocks can be obtained from several sources including petroleum, shale oil, tar sands, coal and the like. Specific feedstocks include decant oil, also known as slurry oil or clarified oil, which is obtained from fractionating effluent from the catalytic cracking of gas oil and/or residual oils. Thermal tar may also be used as a feedstock. This is a heavy oil which is obtained from the fractionation of material produced by thermal cracking of gas oil or similar materials. Another feedstock which may be used is extracted coal tar pitch. In addition, gas oils, such as heavy premium coker gas oil or vacuum gas oil, may also be used in the process. Any of the preceding feedstocks may be used singly or in combination. In addition any of the feedstocks may be subjected to hydrotreating and/or thermal cracking prior to their use for the production of premium grade coke.

Figure 1:
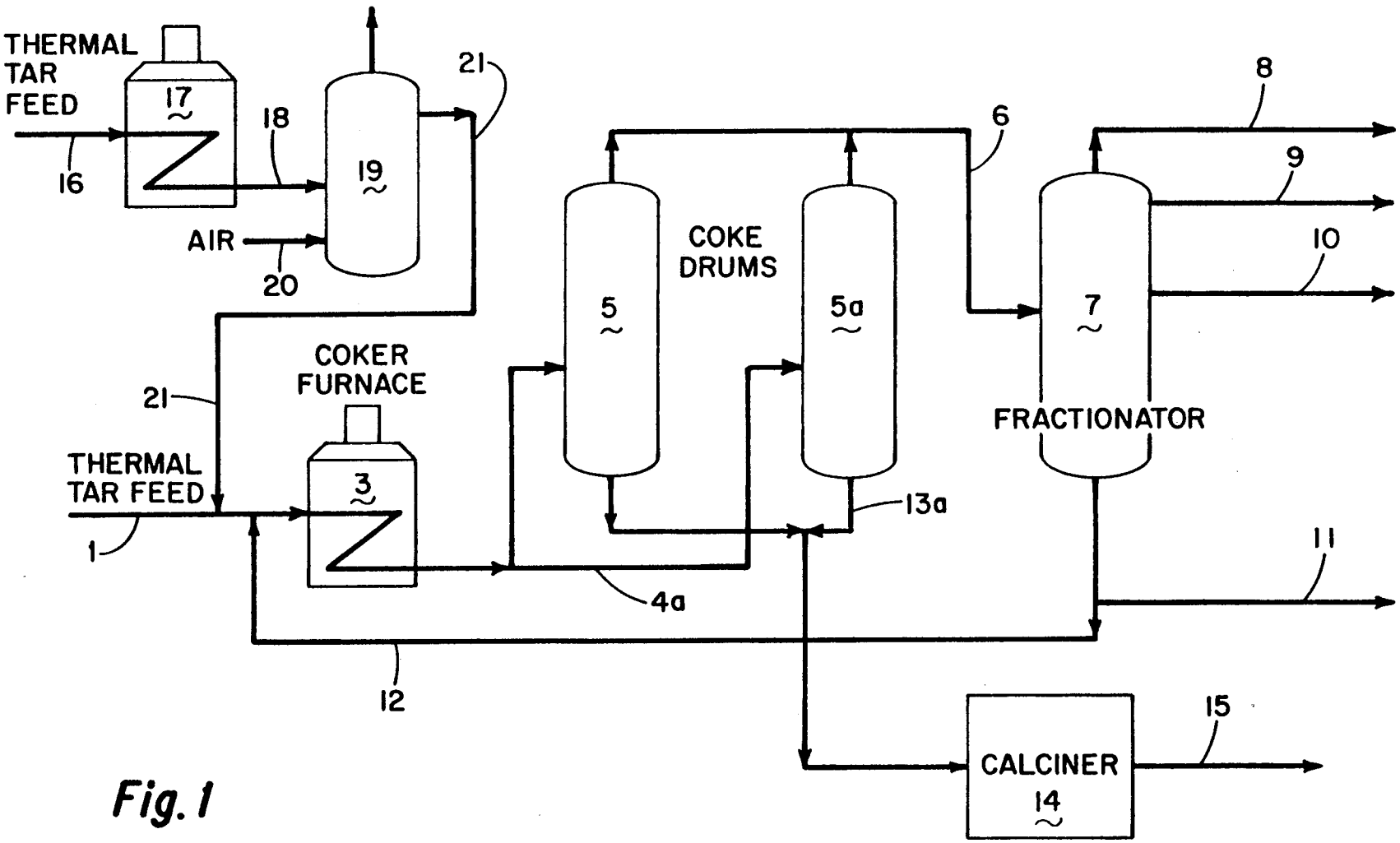
FIG. 1 is a schematic flow diagram of a premium delayed coker which illustrates the invention.

Referring now to FIG. 1, an aromatic feedstock is introduced into the coking process via line 1. The feedstock, which in this instance is a thermal tar, is heated in furnace 3 to temperatures normally in the range of about 850° F. to about 1100° F. and preferably between about 900° F. to about 975° F. A furnace that heats the thermal tar rapidly to such temperatures, such as a pipestill, is normally used. The thermal tar exits the furnace at substantially the above indicated temperatures and is introduced through line 4 into the bottom of coke drum 5 which is maintained at a pressure of between about 15 and about 200 psig. The coke drum operates at a temperature in the range of about 800° F. to about 1000° F., more usually between about 820° F. to about 950° F. Inside the drum the heavy hydrocarbons in the thermal tar crack to form cracked vapors and premium coke.

Vapors produced during the coking operation are continuously removed overhead from coke drum 5 through line 6. The coke accumulates in the drum until it reaches a predetermined level at which time the feed to the drum is shut off and switched through line 4a to a second coke drum 5a wherein the same operation is carried out. This switching permits drum 5 to be taken out of service, opened, and the accumulated coke removed therefrom using conventional techniques. The coking cycle may require between about 16 and about 70 hours but more usually is completed in about 24 to about 48 hours.

The vapors that are taken overhead from the coke drums are carried by line 6 to a fractionator 7. As indicated in the drawing, the vapors will typically be fractionated into a $C_1$-$C_3$ product stream 8, a gasoline product stream 9, a light gas oil product stream 10 and a premium coker heavy gas oil taken from the fractionator via line 11.

As indicated previously, the premium coker heavy gas oil from the fractionator may be recycled at the desired ratio to the coker furnace through line 12. Any excess net bottoms may be subjected to conventional residual refining techniques if desired.

Green coke is removed from coke drums 5 and 5a through outlets 13 and 13a, respectively, and introduced to calciner 14 where it is subjected to elevated temperatures to remove volatile materials and to increase the carbon to hydrogen ratio of the coke. Calcination may be carried out at temperatures in the range of between about 2000° F. and about 3000° F. and preferably between about 2400° and about 2600° F. The coke is maintained under calcining conditions for between about one half hour and about ten hours and preferably between about one and about three hours. The calcining temperature and the time of calcining will vary depending on the density of the coke desired. Calcined premium coke which is suitable for the manufacture of large graphite electrodes is withdrawn from the calciner through outlet 15.

During the latter part of the coking cycle, usually after the mid-point of the cycle, flow of feed through line 1 and furnace 3 is discontinued and thermal tar feed is introduced into the coking process via line 16. The thermal tar from line 16 enters heater 17 Where it is increased in temperature to between about 400° F. and about 1000° F. and preferably to between about 500° F. and about 700° F. The specific temperature attained in the heater will depend on the particular feedstock used. Heater 17 may be a conventional furnace of the type used in oil refineries or it may be a conventional tube and shell exchanger where heat is exchanged with another fluid.

Heated feed passes from heater 17 through line 18 into oxidizer vessel 19 where it is contacted and oxygenated with air introduced via line 20. Contact may be assisted if desired by mechanical mixing or agitation. While air is preferred because of its cost and availability, other oxygen-containing gases, such as oxygen-enriched air, pure oxygen, ozone, peroxides and nitrogen dioxide may be used.

From oxidizer 19 the oxygenated thermal tar is passed via line 21 to coker furnace 3 where it is processed in the manner previously described in the earlier discussion of FIG. 1. Any oxygen or other gases which are not consumed in the oxygenation step are removed from oxidizer 19 through line 2. If desired, a surge or storage tank may be placed in line 21 between oxidizer 19 and coker furnace 3. With this latter arrangement oxygenated feed may be withdrawn from the surge or storage tank and introduced continuously to the coker furnace as required in the coking cycle. The oxygenation step may be carried out either continuously or as a batch operation.

The temperature at which the oxygen-containing gas contacts the feed may vary from as low as about 350° F. to as high as 950° F. If a temperature in the upper portion of this range is used, the contact of oxygen-containing gas with the feed may optionally be carried out in heater 17 or the oxygen-containing gas may be introduced to the heated feed leaving heater 17. While a broad range of contact temperature is within the scope of the process, the oxygenation temperature employed is usually between about 400° F. and about 700° F. and preferably between about 450° F. and about 600° F.

The amount of oxygen brought in contact with the feed in the oxygenation step of the coking process varies from about 1,000 to about 60,000 SCF (standard cubic feet) per ton of feed. More usually when air is used as the oxygen-containing gas, the oxygen input to the process is between about 2,000 and about 20,000 SCF per ton of feed and preferably from about 3,000 to about 15,000 SCF per ton of feed.

The rate at which the oxygen-containing gas is contacted with the feed and the time period of such contact are established to provide the desired oxygen consumption for the particular feedstock used and the contact temperature selected. Broadly, the gas flow rate may vary from about 10 to about 700 SCFM (standard cubic feet per minute) per ton of feed. More usually the flow rate is from about 30 to about 100 SCFM per ton of feed and preferably from about 40 to about 60 SCFM per ton of feed. The contact time employed may vary from about 2 to about 72 hours, but usually is from about 4 to about 24 hours and preferably from about 6 to about 12 hours.

The oxygenated portion of the feed to the coking reaction may be any amount up to about 50.0 weight percent based on the total feed, however, usually the oxygenated feed will vary from about 2.0 to about 40.0 percent by weight of the total feed. More usually, the oxygenated feed will comprise between about 5.0 percent and about 25.0 percent of the coker feedstock. The amount of oxygenated feed used in the process will depend on the severity of the oxygenation step and the particular coking conditions employed. For example, at higher coking temperatures, a lower percentage of oxygenated feed is used. Similarly, higher degrees of oxygenation reduces the percentage of oxygenation feed used in the process.

As pointed out previously, lack of homogeneity in the coke is one of the problems faced in the delayed coking process. Coke produced near the top of the drum where reaction times are short generally has different physical properties than coke produced in the remainder of the drum. This may be evidenced by the CTE (coefficient of thermal expansion) of the coke or by the coke Crush Index which is a measure of the hardness of the coke. Coke which is not uniform presents a problem for graphite producers in several ways. The amount of pitch required, the sizing of the coke, and the ultimate electrode performance all become difficult to predict when coke properties are not consistent.

While the process has been described as utilizing the same feedstock in the normal coking portion of the process as well as the oxygenation portion, it is within the scope of the invention to use different feedstocks in each step. For example, the non-oxygenation coking operation could be carried out using a decant oil feedstock with another feedstock, such as, thermal tar being provided during the oxygenation step.

EXAMPLE 1

A decant oil boiling above 850° F. was coked batchwise at 840° F., 60 psig, and at reaction times of 4, 8, 16, 32, and 64 hours. Six kilograms of the same 850° F.+ decant oil were sparged with air at 465° F. for a total of 53 hours. 15.9 SCFM of air were used for the first 13 hours of oxygenation and 19.9 SCFM of air were used for the last 40 hours. The yield of coker feedstock upon sparging was 97.2 weight percent. Properties of the non-oxygenated and oxygenated decant oils are shown in Table 1.

TABLE 1

| | Non-Oxygenated 850° F.+ Decant Oil | Oxygenated 850° F.+ Decant Oil |
|---|---|---|
| Softening Point, °C. | <45 | 100 |
| API Gravity | −9.9 | −17.1 |
| Sulfur, wt % | 1.04 | 1.03 |
| Oxygen, wt % | 0.50 | 0.70 |
| Alcor Carbon Residue, wt % | 20.6 | 42.8 |
| Viscosity, cs | | |
| 120° C. | 38.8 | — |
| 135° C. | 19.8 | 7640 |
| 150° C. | 11.9 | 1800 |
| 165° C. | — | 602 |
| Metals, ppm | | |
| V | 1.3 | 2.0 |
| Ni | 1.6 | 2.1 |
| Fe | 18 | 17 |
| Cu | <2 | <2 |
| Ti | 18 | 18 |
| Zn | <1 | <1 |
| Ca | <4 | <4 |
| Mn | <2 | <2 |

The oxygenated decant oil was coked batchwise under the same conditions as the non-oxygenated decant oil. Coking results from both the oxygenated and non-oxygenated feeds are shown in Table 2.

TABLE 2

| Feedstock | Run Time, Hrs. 4.0 | 8.0 | 16.0 | 32.0 | 64.0 |
|---|---|---|---|---|---|
| Non-oxygenated 850+ Decant Oil | | | | | |
| Green Coke Yield wt % | 74.1 | 69.7 | 66.8 | 65.4 | 64.3 |
| CTE, $10^{-7}$/°C. | 9.04 | 6.92 | 2.46 | 1.78 | 1.01 |
| No. Of CTE Samples | 4 | 4 | 5 | 5 | 4 |
| Green Coke Crush Index, wt % | 11.6 | 14.6 | 23.3 | 22.7 | 26.2 |
| 850+ Oxygenated Decant Oil | | | | | |
| Green Coke Yield, wt % | 78.8 | 70.0 | 73.5 | 72.8 | 71.5 |
| CTE, $10^{-7}$/°C. | 8.49 | 4.15 | 2.58 | 1.73 | 1.87 |
| No. of CTE Samples | 5 | 5 | 5 | 5 | 5 |
| Green Coke Crush Index, wt % | 15.6 | 23.2 | 24.7 | 27.8 | 33.5 |

TABLE 2-continued

Figure 2:
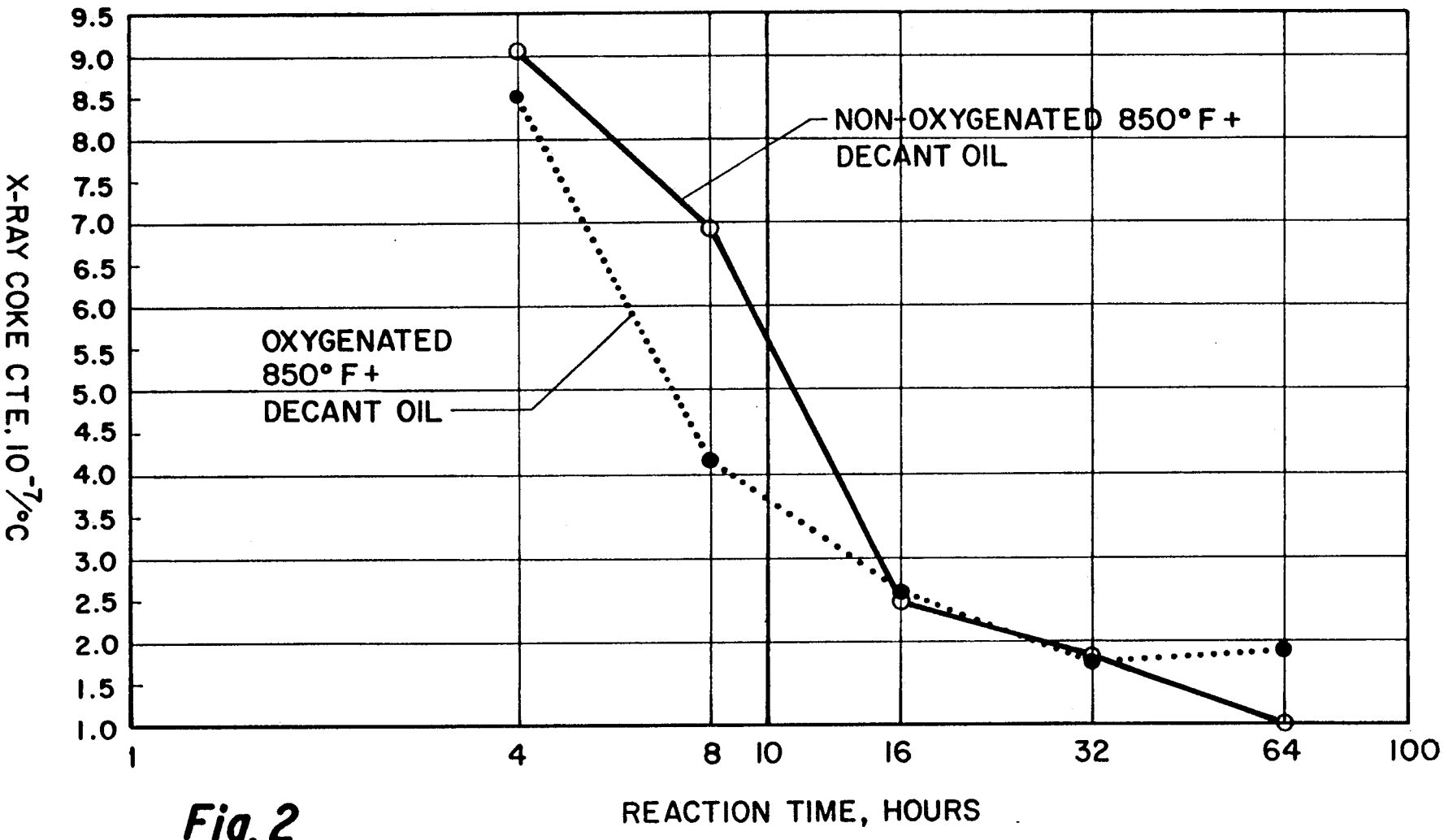
FIG. 2 is a plot of CTE versus coking reaction time of oxygenated and non-oxygenated thermal tar.
Figure 3:
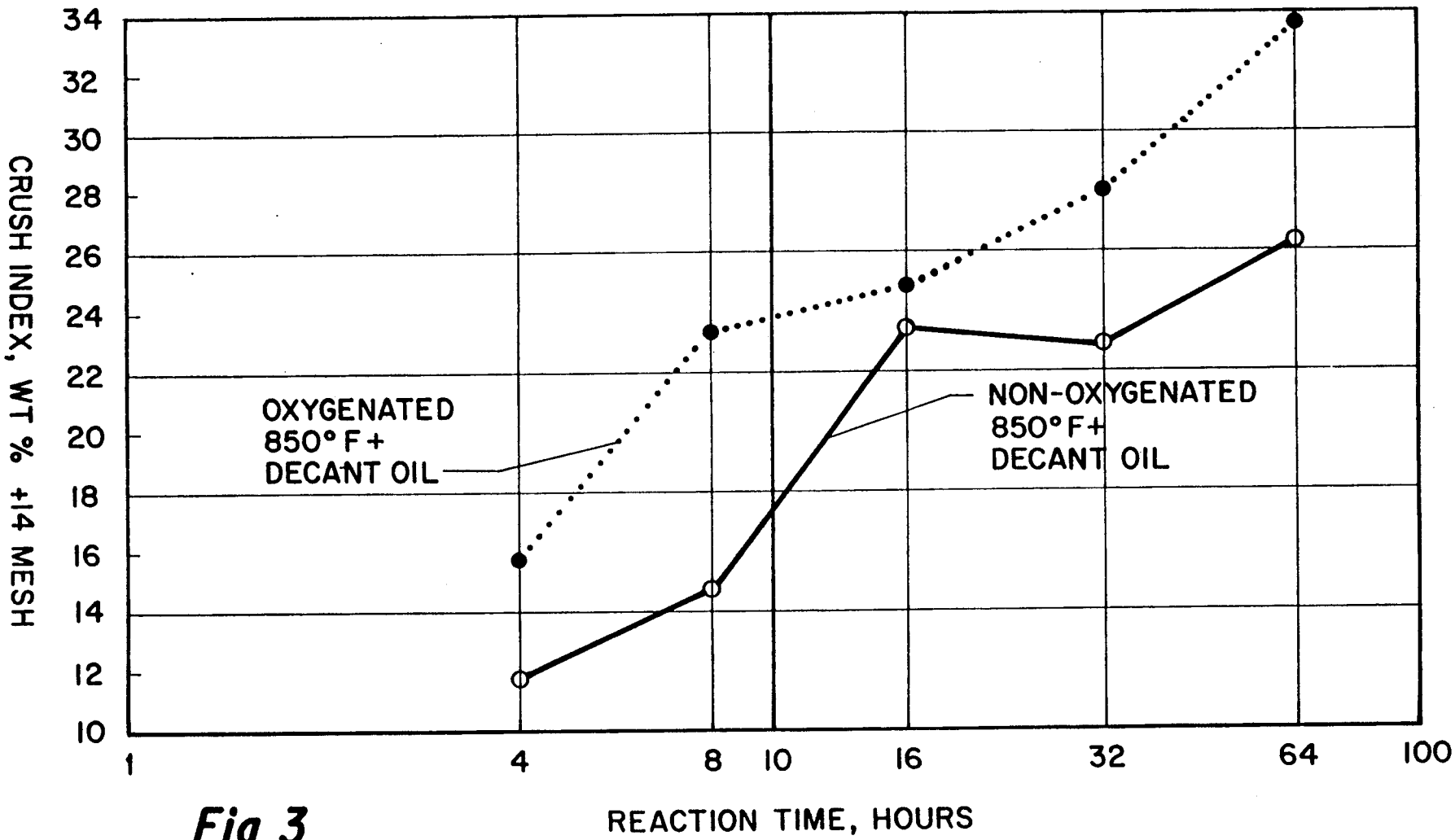
FIG. 3 is a plot of Crush Index versus coking reaction time of oxygenated and non-oxygenated thermal tar.

Coefficient of thermal expansion (CTE) data, obtained from an established x-ray technique, are shown in FIG. 2. It is apparent from FIG. 2 that CTEs of coke from the oxygenated feed are superior to CTEs of coke from the non-oxygenated feed at coking reaction times less than roughly 16 hours. Moreover, coke hardness data, shown in FIG. 3, also show that coke from the oxygenated feed is superior.

Table 3, using data from Example 1, shows average coke properties obtained if the 850° F.+ non-oxygenated decant oil is used exclusively as the feedstock in a commercial operation. This table shows that coke with better overall and more uniform properties can be obtained if the feedstock is oxygenated over roughly the last 15 hours of the fill period.

TABLE 3

| Reaction Time Hr. | Feedstock | X-Ray CTE $10^{-7}$/°C. | Coke Crush Index, wt % +14 Mesh |
|---|---|---|---|
| Feedstock is non-oxygenated 850° F.+ decant oil for the entire fill period. | | | |
| 4 | 850° F.+ Decant Oil | 9.04 | 11.6 |
| 8 | 850° F.+ Decant Oil | 6.92 | 14.6 |
| 16 | 850° F.+ Decant Oil | 2.46 | 23.3 |
| 32 | 850° F.+ Decant Oil | 1.78 | 22.7 |
| 64 | 850° F.+ Decant Oil | 1.01 | 26.2 |
| | Avg. | 4.24 | 19.7 |
| Feedstock is non-oxygenated 850° F.+ decant oil for all but the last 15 hours of the fill period | | | |
| 4 | Oxygenated 850+ Decant Oil | 8.49 | 15.6 |
| 8 | Oxygenated 850+ Decant Oil | 4.15 | 23.2 |
| | Non-oxygenated | | |
| 16 | 850+ Decant Oil | 2.46 | 23.3 |
| 32 | 850+ Decant Oil | 1.78 | 22.7 |
| 64 | 850+ Decant Oil | 1.01 | 26.2 |
| | Avg. | 3.58 | 22.2 |

In Table 3 the last 15 hours of the fill period represents 23.5 weight percent of the total feed to the coke drum during the coking cycle.

EXAMPLE 2

Figure 4:
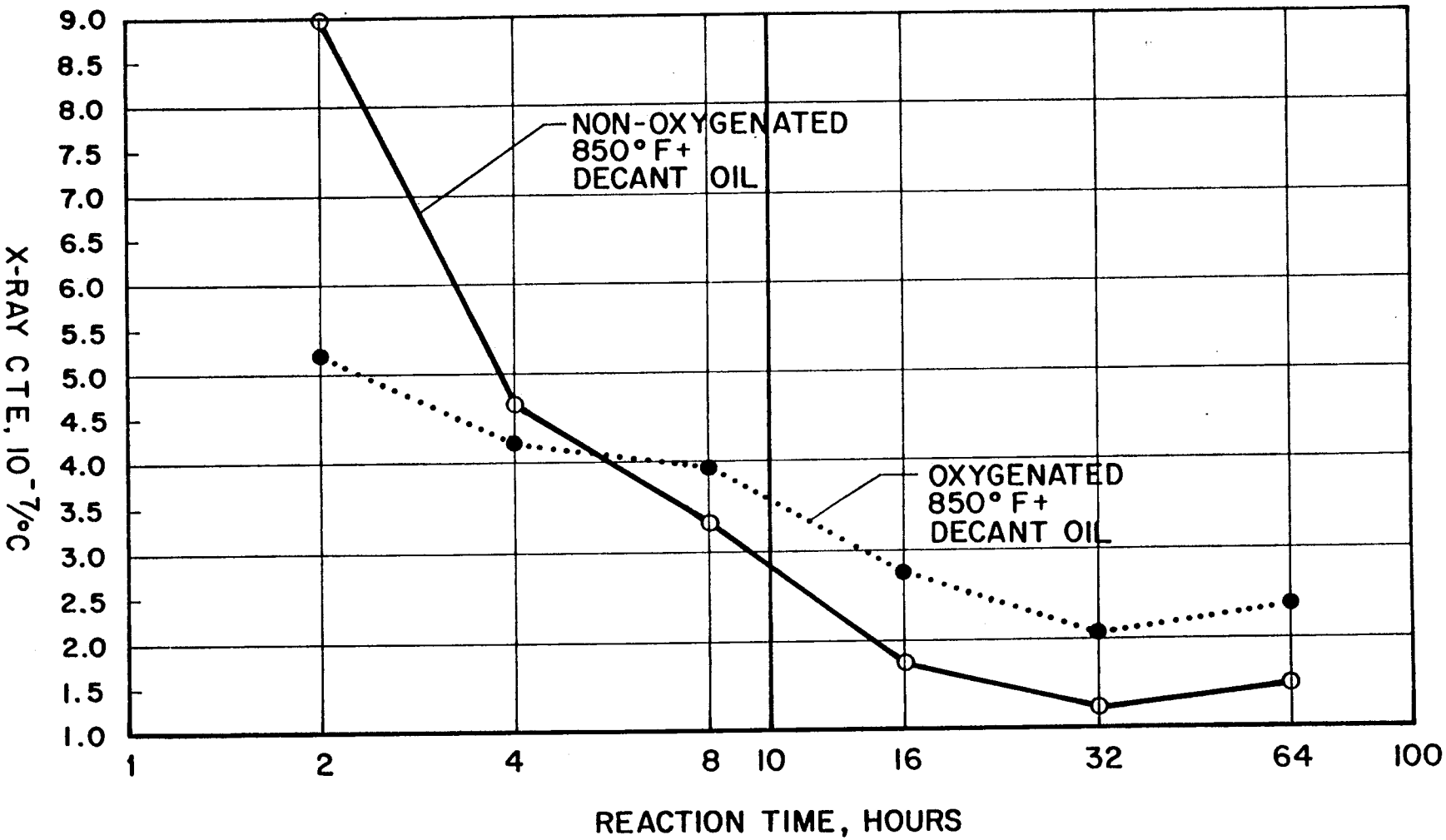
FIG. 4 is another plot of CTE versus coking reaction time of oxygenated and non-oxygenated thermal tar.

The same non-oxygenated 850° F.+ decant oil and oxygenated 850° F.+ decant oils used in Example 1 also were used in this example. In this case, however, coking was completed batchwise at 865° F., 60 psig, and at reaction times of 2, 4, 8, 16, 32, and 64 hours. Results from coking both feeds are summarized in Table 4. X-ray CTE data are plotted versus reaction time in FIG. 4.

TABLE 4

| Feedstock Description | Run Time, Hrs. 2.0 | 4.0 | 8.0 | 16.0 | 32.0 | 64.0 |
|---|---|---|---|---|---|---|
| Non-oxygenated 850+ Decant Oil | | | | | | |
| Green Coke Yield | 71.5 | 67.9 | 64.5 | 61.4 | 62.1 | 62.7 |
| CTE, $10^{-7}$/°C. | 8.95 | 4.63 | 3.30 | 1.72 | 1.21 | 1.48 |
| No. Of CTE Samples | 8 | 4 | 8 | 4 | 4 | 4 |
| Oxygenated 850+ Decant Oil | | | | | | |
| Green Coke Yield (On Charge), wt % | 76.4 | 73.8 | 71.6 | 70.3 | 69.4 | 69.7 |

TABLE 4-continued

| Feedstock Description | Run Time, Hrs. 2.0 | 4.0 | 8.0 | 16.0 | 32.0 | 64.0 |
|---|---|---|---|---|---|---|
| CTE, $10^{-7}$/°C. | 5.18 | 4.19 | 3.92 | 2.73 | 2.04 | 2.36 |
| No. of CTE Samples | 4 | 5 | 6 | 4 | 4 | 4 |

At this higher coking temperature the oxygenated feed produces coke of superior CTE during roughly the first 5 or 6 hours of reaction time. Hence, if an oxygenated feed is used during roughly the last 4 to 5 hours of the fill period, more uniform coke with better overall properties is obtained. This is shown in Table 5.

TABLE 5

| Reaction Time, Hr. | Feedstock | X-Ray CTE, $10^{-7}$/°C. |
|---|---|---|
| CASE A: Feedstock is non-oxygenated 850° F.+ decant oil for the entire fill period. | | |
| 2 | 850° F.+ Decant Oil | 8.95 |
| 4 | 850° F.+ Decant Oil | 4.63 |
| 8 | 850° F.+ Decant Oil | 3.30 |
| 16 | 850° F.+ Decant Oil | 1.72 |
| 32 | 850° F.+ Decant Oil | 1.21 |
| 64 | 850° F.+ Decant Oil | 1.48 |
| | Avg. | 3.55 |
| CASE B: Feedstock is non-oxygenated 850° F.+ decant oil for all but the last 4-5 hours of the fill period. | | |
| 2 | Oxygenated 850° F.+ Decant Oil | 5.18 |
| 4 | Oxygenated 850° F.+ Decant Oil | 4.19 |
| | Non-oxygenated | |
| 8 | 850° F.+ Decant Oil | 3.30 |
| 16 | 850° F.+ Decant Oil | 1.72 |
| 32 | 850° F.+ Decant Oil | 1.21 |
| 64 | 850° F.+ Decant Oil | 1.48 |
| | Avg. | 2.85 |

In Table 5 the last 4-5 hours of the fill period represent 6.25-7.82 weight percent of the total feed to the coke drum during the coking cycle.

While certain embodiments and details have been shown for the purpose of illustrating the present invention, it will be apparent to those skilled in the art that various changes and modifications may be made herein without departing from the spirit or scope of the invention.

We claim:

1. In a delayed premium coking process in which an aromatic mineral oil feedstock is heated to elevated temperature and introduced continuously to a coking drum under delayed coking conditions wherein the heated feedstock soaks in its contained heat to convert the feedstock to cracked vapors and premium coke and in which the introduction of feedstock to the coking drum is discontinued after the coking drum is filled to the desired level, the improvement which comprises (a) adding from about 50 weight percent to about 98 weight percent of non-oxygenated feedstock to the coke drum and (b) adding from about 2 weight percent to about 50 weight percent of oxygenated feedstock to the coke drum after the mid-point of the drum-filling portion of the coking cycle.

2. The process of claim 1 in which oxygenating is carried out by contacting the mineral oil with an oxygen-containing gas.

3. The process of claim 2 in which the oxygen-containing gas is air.

4. The process of claim 3 in which the oxygenated portion of the mineral oil feedstock varies from about 2.0 weight percent to about 40.0 weight percent of the total mineral oil feedstock.

5. The process of claim 3 in which the aromatic mineral oil feedstock is selected from the group consisting of decant oil, pyrolysis tar, vacuum resid, vacuum gas oil, thermal tar, heavy premium coker gas oil, virgin atmospheric gas oil, extracted coal tar pitch and mixtures thereof.

6. In a delayed premium coking process in which an aromatic mineral oil feedstock is heated to between about 850° F. and about 1100° F. and introduced continuously to a coking drum wherein the heated feedstock soaks in its contained heat at a temperature between about 800° F. and about 1000° F. and a pressure between about 15 psig and about 200 psig for a time period of between about 4 to about 70 hours which is sufficient to convert the feedstock to cracked vapors and premium coke and in which the introduction of feedstock to the coking drum is discontinued after the coking drum is filled to the desired level, the improvement which comprises (a) adding from about 50 weight percent to about 98 weight percent of non-oxygenated feedstock to the coke drum and (b) adding from about 2 weight percent to about 50 weight percent of oxygenated feedstock to the coke drum after the mid-point of the drum-filling portion of the coking cycle.

7. The process of claim 6 in which oxygenation is carried out by contacting the aromatic mineral oil with an oxygen-containing gas at a gas flow rate between about 10 and about 700 SCFM (standard cubic feet per minute) per ton of mineral oil and at a temperature between about 350° F. and 950° F. for about 2 to 72 hours to effect contact with the mineral oil of between about 1,000 and about 60,000 SCF (standard cubic feet) of oxygen per ton of mineral oil.

8. The process of claim 7 in which the oxygenated portion of the mineral oil feedstock varies from about 2.0 weight percent to about 40.0 weight percent of the total mineral oil feedstock.

9. The process of claim 8 in which the oxygen-containing gas is air.

10. The process of claim 8 in which the aromatic mineral oil feedstock is selected from the group consisting of decant oil, pyrolysis tar, vacuum resid, vacuum gas oil, thermal tar, heavy premium coker gas oil, virgin atmospheric gas oil, extracted coal tar pitch and mixtures thereof.

* * * * *